US007377285B2

(12) United States Patent
Karasin et al.

(10) Patent No.: US 7,377,285 B2
(45) Date of Patent: May 27, 2008

(54) WALKER

(76) Inventors: Craig E. Karasin, 805 Albury Ct., Moorestown, NJ (US) 08057; Thomas J. Powers, 705 Hidden Forest Ct., Fairless Hills, PA (US) 19030; David G. Reed, 2735 Arrowhead Dr., Langhorne, PA (US) 19053

( * ) Notice: Subject to any disclaimer, the term of this patent is extended or adjusted under 35 U.S.C. 154(b) by 234 days.

(21) Appl. No.: 10/924,685

(22) Filed: Aug. 24, 2004

(65) Prior Publication Data

US 2005/0076939 A1 Apr. 14, 2005

Related U.S. Application Data

(60) Provisional application No. 60/497,633, filed on Aug. 25, 2003.

(51) Int. Cl.
*A61H 3/04* (2006.01)

(52) U.S. Cl. ..... 135/67; 135/66; 135/72; 135/74; 280/87.021; 482/68

(58) Field of Classification Search ..... 135/66–67, 135/72, 74, 76; 482/66–68; 297/5; 280/87.021, 280/87.371, 250.1, 642, 647–649; D12/130
See application file for complete search history.

(56) References Cited

U.S. PATENT DOCUMENTS 4,094,331 A * 6/1978 Rozsa ..... 135/67
4,411,283 A * 10/1983 Lucarelli ..... 135/67
4,748,994 A * 6/1988 Schultz et al. ..... 135/67
5,020,560 A * 6/1991 Turbeville ..... 135/67
5,347,666 A * 9/1994 Kippes ..... 5/81.1 R
5,603,517 A 2/1997 Lorman
5,785,070 A 7/1998 Block
5,794,639 A 8/1998 Einbinder
5,961,430 A * 10/1999 Zuckerman et al. ..... 482/142
6,014,981 A 1/2000 Douglass
6,099,002 A * 8/2000 Uchiyama ..... 280/87.021
6,688,633 B2 * 2/2004 van't Schip ..... 280/642
6,733,018 B2 * 5/2004 Razon ..... 280/87.021
6,743,156 B1 * 6/2004 Jacques et al. ..... 482/68
2002/0084617 A1 7/2002 Torsiello

FOREIGN PATENT DOCUMENTS

AU 51840 4/1980
GB 2061118 * 5/1981
WO WO 95/31954 * 11/1995
WO 00/67819 11/2000

* cited by examiner

*Primary Examiner*—Winnie Yip
(74) *Attorney, Agent, or Firm*—Synnestvedt & Lechner LLP

(57) ABSTRACT

A walker is disclosed having two sets of handles positioned for rising from and lowering to a seated position in addition to serving as a walking aid. The walker comprises a frame having a front section comprising a pair of front vertical supports and a rigid cross-piece, and two side sections each comprising a rear vertical support having a load-bearing axis formed through a ground-engaging point, rigid connectors connecting the side sections to the front section, a first pair of handles positioned to support a user in a standing or walking position, and a second pair of handles positioned below and to the rear of the first set of handles to support a user in rising from or lowering to a seated position, in which the geometric centers of each of the second pair of handles is positioned to the rear of the load-bearing axis of each of the rear vertical supports.

20 Claims, 7 Drawing Sheets

WALKER

CROSS REFERENCE TO RELATED APPLICATION

This application claims the benefit of U.S. Provisional Application No. 60/497,633, filed Aug. 25, 2003, which is hereby incorporated herein by reference.

FIELD OF THE INVENTION

The invention relates to walking assist devices having auxiliary handles positioned to assist a person in rising from and lowering to a seated position.

BACKGROUND OF THE INVENTION

Various types of devices have been employed to assist people who are recovering from various types of injuries and surgery, or who are experiencing weakness or instability from conditions associated with advanced age or other causes, in moving to and from a seated position. Complicated and expensive devices such as tilting chairs and the like have been developed for such purposes. Various types of four-legged walkers and devices designed to be supported by a chair or bed have also been used for this purpose.

Developers in the field have given attention to the problem and various cane and cane-like devices are disclosed in a number of patent or patent-related documents. British patent application No. GB2136290A to Walker; U.S. Pat. No. 3,289,685 to Parker; and U.S. Pat. No. 4,562,850 to Early et al. disclose devices with a plurality of handles and a cane-like structure. Also, U.S. Pat. No. 1,400,394 to Warry discloses a telescoping crutch-like device with a single shaft in which an auxiliary handle may be gripped when the crutch is fully extended.

The device of Walker has four handles at the top of the device and the lower handles may be gripped by a person seated for the purpose of pulling on the handles with the device in a front position in pulling oneself into a standing condition. The upper and lower handles of the Walker device are located close to one another and the device is such that it has two pair of handles located at two different levels of the cane.

The device of Parker has two handles, but the handles are not located with their geometric centers above the shaft member. The principal use of the two handles of the Parker cane is for stability when a user is traversing uneven terrain. The upper and lower handles of Parker are relatively close together, e.g., about six inches. Thus, as one attempts to use these canes, the pressure of the handles will cause some rotational force upon the wrist of the user when trying to rise from a seated position. Since many users have arthritic conditions, torque on the wrist is disadvantageous and generally to be avoided. Furthermore, the handles of the Parker device are sufficiently close together that one using such a cane, especially alongside a chair, would experience an uncomfortable position for the wrist, hand, and forearm because of the limited space available between the handles. Again, as with the Walker device, the more comfortable and biomechanically advantageous position in which to use a cane for uprisal purposes is alongside a chair and close to one's center of gravity when seated. The close proximity of the two handles of Parker does not readily permit this type of convenient use of the device.

The device of Early has a collar close to the handle of the cane. The collar provides a small surface for a person to try to pull on in order to pull oneself into a standing position. The collar, however, is positioned too close to the handle to be used effectively in a pushing-down motion.

Another patent disclosing a supplementary handle is U.S. Pat. No. 4,121,605 to Schmerl which has a long stabilizing bar pivoted in close proximity to the cane handle and the bar may be rotated to a substantially perpendicular position with respect to the cane shaft. A second hand may be placed along the stabilizing bar when a user of the cane has his or her other hand on the cane handle in a standing position. This bar is also located close to the main cane handle and therefore disadvantageous in assisting a person rising from a chair.

Other structures, such as that illustrated in U.S. Pat. No. 4,941,495 to Boyce et al. have also been developed to provide uprisal aid. This device has a pair of arm-rests which are laterally spaced a sufficient distance to encompass the hips of a user. These armrests provide hand support for a person rising from a seated to a standing position.

In addition to the development of canes as walking assist devices and uprisal assist devices, other walking assist devices have been developed with multiple leg members to provide stabilized support for the user during walking. Such devices include walkers which typically have four spaced apart legs as, for example, disclosed in U.S. Pat. No. 3,442,276 to Edwards, et al. The user advances the walker ahead of himself or herself the distance of an arm length, and then leans upon the walker as he or she walks forward toward the walker.

Walker devices have been disclosed in the patent literature which also provide assistance in uprisal from a sitting position. U.S. Pat. No. 4,474,202 to Blechner discloses a walker having two, spaced apart foot rests upon which the user places his or her feet while grasping a forward bar to pull himself or herself up to a standing position. The use of the footrests requires specific positioning that can be awkward to use and therefore unsafe.

U.S. Pat. No. 5,347,666 to Kippes discloses an uprisal device having extended horizontal rods at ground level to counterbalance the user's pull on a front bar of the device. The Kippes device also discloses the need for having a second person, in a standing position, to serve as an anchor on the front part of the device to aid the user in uprisal. The Kippes structure serves only as an uprisal device and not as a walking-assist device.

U.S. Pat. No. 4,941,496 to Berning discloses a walking assist device having two legs and two sets of spaced apart grips to assist the user in rising from a seated position or in climbing stairs. The two vertically spaced grips of the Berning device are spaced so closely together, however, that the device cannot be used effectively as an uprisal-assist device. In addition, the Berning device is inherently unstable because of its substantially elongated vertical profile.

U.S. Pat. Nos. 5,005,599 and 5,445,174, both to Cunningham, disclose walker devices which have attached, articulating brace members that swing outwardly from the walker frame to be positionable over the horizontal surface of a chair or other seating structure. The extended braces are designed to be grasped by the user to assist in rising from a seated position. Such braces, however, are laterally unstable by virtue of their rotatable attachment to the walker frame. The Cunningham devices also require a stable surface upon which the braces are supported during uprisal. Therefore, such devices are disadvantageous as uprisal assist devices.

U.S. Pat. No. 5,785,070 to Block et al. discloses a walker which has, in addition to the handles for use while standing or walking, a second set of handholds for use in assisting a person in rising from and lowering to a seated position. The second set of handholds of the Block walker, like the handholds of other conventional walkers, provides stability to a user by virtue of being positioned in front of the longitudinal axis formed through the ground engaging tips and the rear legs. As a result of this positioning, however, the second set of handholds is disadvantageously located distant from a seated user.

The walking assist devices previously described provide varying proficiency in assisting a person wishing to rise from a seated position, but each has its own disadvantages relating principally to the instability of the device and/or the ease of use. By their designs, the support handles of these devices that are intended for assisting the user in uprisal are either unstable or positioned inconveniently to a person in a seated position behind the walker. Thus, it would be advantageous to provide a combined walking-assist and uprisal-assist device which is both stable and configured to provide conveniently located handholds to readily assist a user in both rising from and lowering to a seated position.

SUMMARY OF THE INVENTION

In accordance with the present invention, a walker is provided which is both ergonomically and biomechanically configured for assisting a user in walking as well as in rising from and lowering to a seated position. The walker comprises a frame having a pair of front vertical supports spaced apart and rigidly connected by a cross-piece, and a pair of rear vertical supports having a load-bearing axis formed through a ground engaging point of each rear vertical support connected to the front vertical supports by a pair of rigid connectors. A first pair of handles is attached to the frame at the upper end of each of the front vertical supports positioned and extending rearward from the front vertical supports. A second pair of handles is attached to the frame at the upper end of each of the rear vertical supports positioned below and to the rear of the first set of handles. The geometric centers of the second pair of handles are each positioned to the rear of the load-bearing axis of the rear vertical support to which they are attached. In this configuration, the first pair of handles is positioned to support a user when in a standing or walking position, and the second pair of handles are positioned to be easily graspable and to support a user when rising from or lowering to a seated position. The walker may further comprise additional rigid connectors between the front and rear vertical supports, wheels and/or skids at the lower ends of the front and/or rear vertical supports, a seat, pockets or other types of compartments for carrying personal items, and attachment points for accessories such as poles, tools such as grabbers, and for supporting personal and/or medical items.

DETAILED DESCRIPTION OF THE INVENTION

Figure 1:
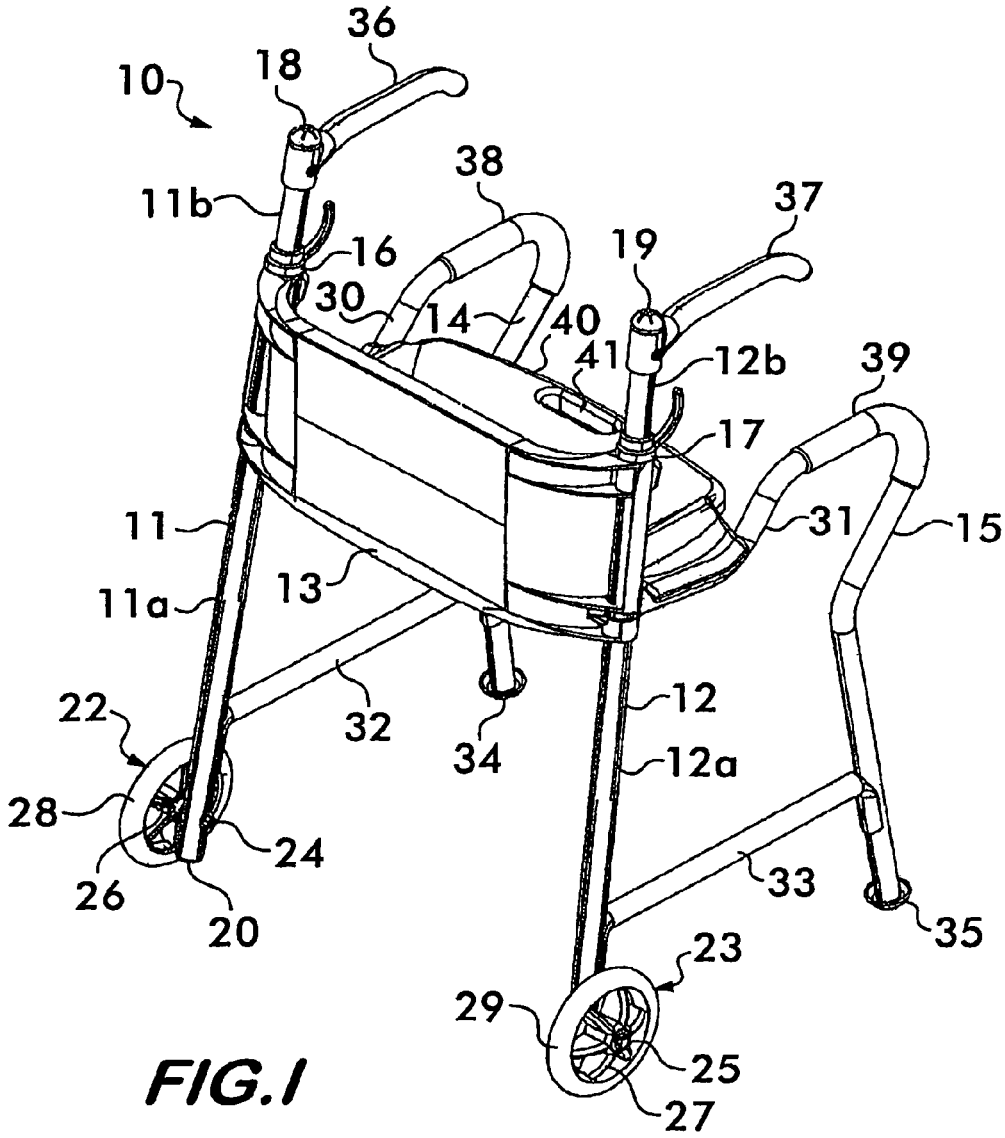
FIG. 1 is a front perspective view of one embodiment of the walker of the present invention.
Figure 2:
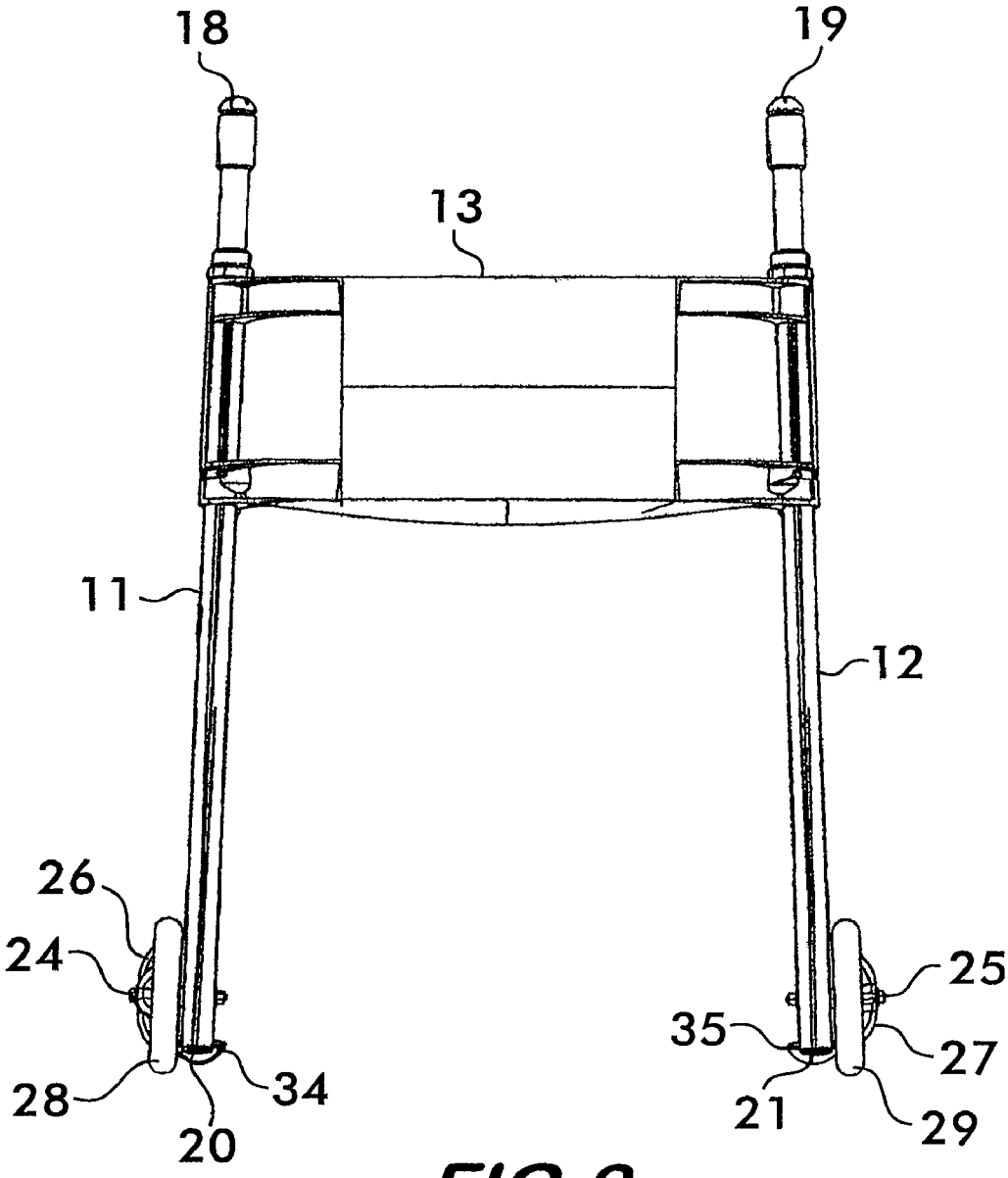
FIG. 2 is a front view of the walker as shown in FIG. 1.
Figure 3:
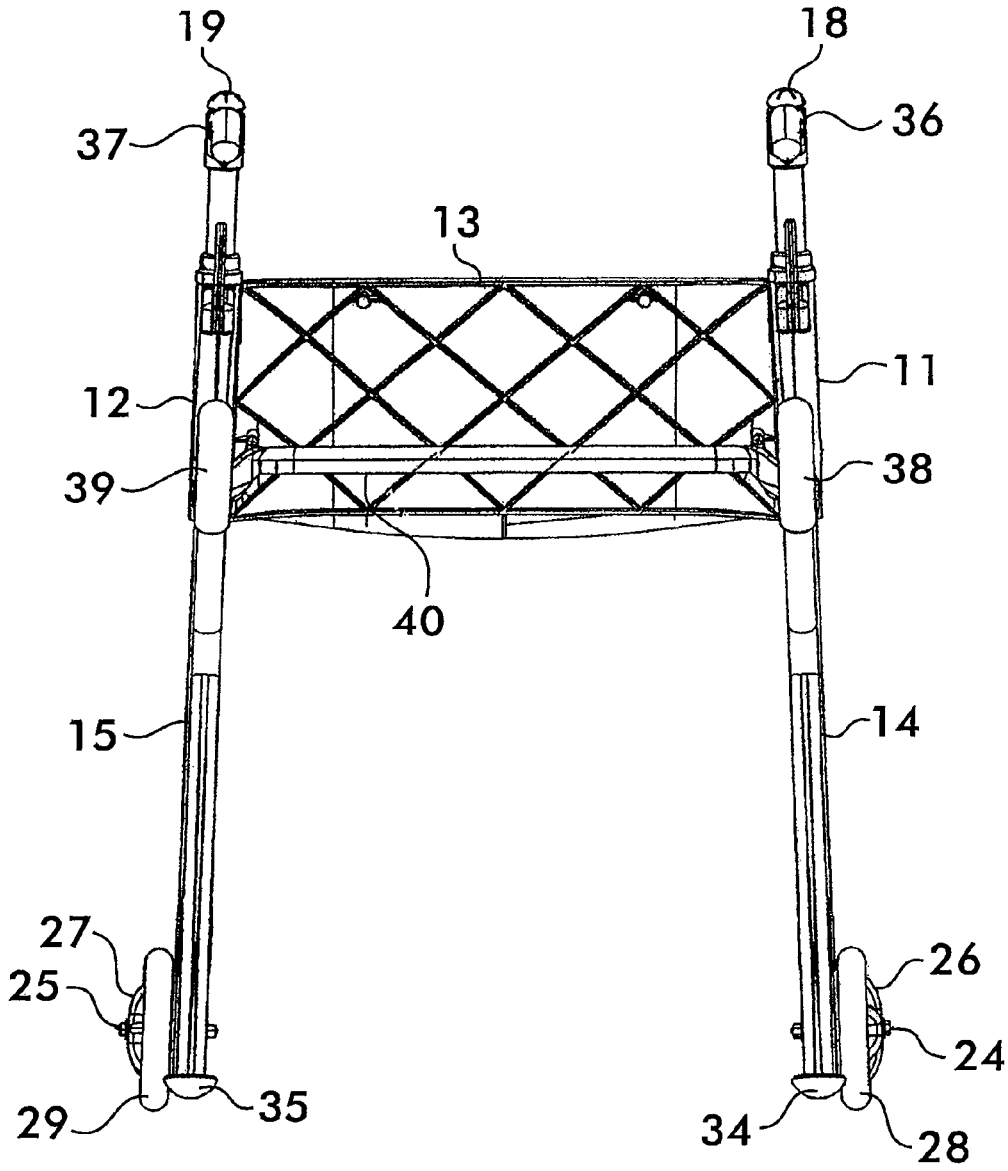
FIG. 3 is a rear view of the walker as shown in FIG. 1.

The present invention provides a walker configured for assisting a user in walking as well as in rising from and lowering to a seated position which has a number of advantages both in manufacture and in use. The walker comprises a three-sided frame having a front section and two side sections which define a space to be occupied by a user during use of the walker in standing or walking. The frame of the walker comprises a pair of front vertical supports which are spaced apart and connected by a rigid cross-piece positioned between the front vertical supports, and a pair of rear vertical supports connected to the front vertical supports by at least one pair of rigid connectors. In an alternative embodiment, the walker comprises two-sided frame having a single front vertical support and a pair of rear vertical supports attached to the single front vertical support which define a triangular space to be occupied by a user during use of the walker in standing or walking. While the detailed description of the invention provided herein is with reference to a walker having a three-sided frame, it will be understood that the present invention also extends to walkers having two-sided frames, and the other features of the invention as set forth herein are equally applicable and adaptable thereto.

The frame is sized generally to accommodate use by persons of various heights and sizes and may be made from any suitable material or combinations of materials that are capable of supporting the loads commonly applied by a person during use in walking, rising and sitting down. Suitable materials include, for example, metals such as aluminum and steel, composite materials, ceramics and plastics. In one embodiment, the walker frame comprises aluminum tubing.

The components of the frame may be rigidly connected to each other to form three sides that are incapable of relative movement. Alternatively, the components of the frame may be pivotably connected so that the two side sections of the frame may be independently rotated inward toward the front section to fold the frame for transport or storage. In one embodiment of the frame, the pivot axis for each side section of the frame is located along the front vertical support where the rigid connectors are attached. In an alternative embodiment, the pivot axis for each side section of the frame is located at the lateral ends of the cross-piece where the front vertical supports are attached. In embodiments having pivot axes, the frame may further comprise at least one mechanism disposed at a pivot axis or remote from a pivot axis that permits the components of the frame to be locked in an "open" position during use and released to allow for movement of the side sections relative to the front section to a "closed" position. As shown in FIGS. 1-7, one embodiment of the walker 10 comprises front vertical supports 11 and 12 pivotably attached to cross-piece 13 with locking mechanisms 16 and 17 disposed at each pivot axis.

Each of the front vertical supports may be a unitary structure or may comprise two or more sections that allow for relative movement so that adjustments to be made in the length of the front vertical supports. In embodiments in which the frame comprises tubing, such as aluminum tubing, each front vertical support may comprise one section of tubing or two or more sections of tubing of differing diameters arranged coaxially to permit adjustment of the length of the front vertical supports by telescoping one section of tubing within another. FIGS. 1-7 show an embodiment of the walker having front vertical supports 11 and 12 comprising lower tubing sections 11*a* and 12*a* and upper tubing sections 11*b* and 12*b* coaxially arranged. Front vertical supports that comprise two or more sections may further comprise a locking mechanism that can allow, restrict or prevent relative movement of the sections of tubing comprising the front vertical supports.

The top of one or both of the front vertical supports may provide one or more attachment points for the attachment of accessories to the walker. In embodiments in which the front vertical supports comprise tubing, the top of one or both of the front vertical supports may be provided with an open end that may be further provided with a cap for covering the open end. FIGS. 1-5 and 7 show an embodiment of the walker in which front vertical supports 11 and 12 are provided with caps 18 and 19. The caps may be positioned at the open end permanently or removably so as to permit the front vertical support to receive a compatible accessory, such as a pole or tool (not shown). Poles inserted into the top of one or both front vertical supports may be used to support personal items or medical items such as medications, an intravenous bag or an oxygen tank. Tools insertable into the top of one or both front vertical supports may be, for example, a grabber that permits the user to grasp and/or manipulate objects from a distance such as, from a high shelf.

The bottom of each front vertical support may also end in a cap and may further comprise a wheel assembly or glide assembly attached thereto. FIGS. 1-7 show an embodiment of the walker in which front vertical supports 11 and 12 terminate at their lower ends with caps 20 and 21, and attached near the bottom are wheel assemblies 22 and 23, comprising axles 24 and 25, wheels 26 and 27, and tires 28 and 29. Embodiments in which wheel assemblies are used may be of any standard construction suitable for use in a walker. Such wheel assemblies commonly comprise an axle mounted to the support, a metal or plastic wheel having a central bore for receipt of the axle, and a solid or inflatable rubber tire mounted on the wheel. Walkers having wheels may further comprise brakes, such as hand brakes, for controlling the rotational speed of the wheels. In an alternative embodiment, the bottom end of each front vertical support is provided with a glide assembly. The glide assembly may be made in any of a variety of suitable shapes and sizes from a range of suitable materials such as metal or plastic.

In one embodiment, the front vertical supports are provided with plastic, mushroom-shaped glides having a stem portion and a cap portion. In such embodiment, the stem portion of such mushroom-shaped glides may be configured as a solid or hollow member capable of being inserted into the lower end of the front vertical supports. Alternatively, the stem portion may be configured with a cavity for receipt of the lower end of the front vertical supports. Engagement between the stem portion and the lower end of each vertical support may be due to a friction fit or the result of a locking mechanism and may be permanent or temporary so as to readily allow replacement of worn glides. The cap portion of such mushroom-shaped glides may be integral with the stem portion as aspects of a unitary structure or may comprise a discrete element permanently or removably attached to the stem portion of the glide. In either configuration, the cap portion of the glide provides a surface that readily permits translational movement of the walker in any direction in the horizontal plane. Moreover, the mushroom-shaped glides of the present invention are similarly adaptable to conventional walkers of all types.

The cross-piece may be any rigid structure capable of connecting and maintaining the front vertical supports in a fixed and stable position relative to each other. The cross-piece may be a unitary structure or may comprise two or more parts such as bars, tubes or panels. The cross-piece may be made from any suitable material capable of supporting the loads commonly applied by a person to a walker during use in walking, rising and sitting down. Examples of suitable materials include plastics, composite materials, ceramics or metals such as steel or aluminum. In one embodiment, an example of which is shown in FIGS. 1-7, cross piece 13 comprises a rigid, unitary, molded plastic panel connecting the front vertical supports 11 and 12 to each other.

Each of the rear vertical supports may be a unitary structure or may comprise two or more sections that allow for adjustments to be made in the length of the rear vertical supports. In embodiments in which the frame comprises tubing, such as aluminum tubing, each rear vertical support may comprise either one section of tubing or two or more sections of tubing of differing diameters arranged coaxially to permit adjustment in length by telescoping of one section of tubing within another. Embodiments with two or more sections of tubing may further comprise a locking mechanism that can allow or prevent relative movement of the sections of tubing comprising the rear vertical supports. FIGS. 1-7 show an embodiment of the walker comprising unitary rear vertical supports 14 and 15.

The rear vertical supports are connected to the front vertical supports by at least one pair of rigid connectors. In embodiments having only one pair of connectors, each connector is attached to a front vertical support at a position spaced from the bottom of the front vertical support and to a corresponding rear vertical support either at the top of the rear vertical support, at or through where the second handle connects to the rear vertical support, or at a position spaced below the second handle. In embodiments in which a second pair of connectors is used, the front and rear vertical supports may be connected at two points each thereby providing greater structural integrity and rigidity. FIGS. 1-7 show an embodiment of the walker comprising two pairs of connectors in which a first pair of connectors 30 and 31 attach at one end to the central portion of front vertical supports 11 and 12 and on the other end to the top of rear vertical supports 14 and 15, and a second pair connectors 32 and 33 extend horizontally as braces between the lower ends of the corresponding left and right side front vertical supports 11 and 12 and rear vertical supports 14 and 15.

The bottom of each rear vertical support may also end in a cap and may further comprise a wheel assembly attached thereto as described above with respect to the front vertical supports. Walkers having wheels attached to the rear vertical supports may further comprise brakes, such as hand brakes, for controlling the rotational speed of the wheels. In an alternative embodiment, the bottom end of each rear vertical support is provided with a glide assembly. The glide assembly may be made in any of a variety of suitable shapes and sizes from a range of suitable materials such as metal or plastic. In one specific embodiment, the rear vertical supports are provided with plastic, mushroom-shaped glides. FIGS. 1-7 show an embodiment of the walker in which rear vertical supports 14 and 15 terminate at their lower ends with glides 34 and 35.

The front and rear vertical supports, together with the cross-piece and the one or more pairs of rigid connectors, comprise the frame of the walker. As used herein, "vertical" in reference to the front and/or rear supports is meant to include not only vertical, i.e., perpendicular to the horizontal plane, but also in orientations skewed from vertical in any direction up to 45 degrees.

A first pair of handles is attached to the frame at the upper end of each of the front vertical supports. Each of the first pair of handles extends rearward from the front vertical support to which it is attached and is positioned for grasping by a user while in an upright position. The first pair of handles may be permanently attached to the front vertical supports, or attached to allow for subsequent adjustment, removal and/or replacement. Adjustable handles may be provided with a mechanism, such as a lock or clamp, that allows, restricts or prevents relative movement of the first pair of handles and the front vertical supports to which they are attached. Removable handles may be subsequently re-attached or replaced with other handles of the same type or handles of a different size, shape and/or material according to the needs of the user. In embodiments of the walker in which the front vertical supports comprise at least two sections, the first pair of handles is preferably positioned on the upper sections. In such embodiments, the height of the first pair of handles from the ground may be readily adjusted to accommodate differently-sized users by movement of only the upper sections of the front vertical supports rather than by adjustment of sections on all four vertical supports. FIGS. 1-5 and 7 show an embodiment of the walker with a first pair of handles 36 and 37 attached to the top end of front vertical supports 11 and 12.

A second pair of handles is provided on the walker to serve as handholds in rising from and lowering to a seated position. The second pair of handles are attached to the rear vertical supports, below and to the rear of the first pair of handles, and positioned so that the geometric centers of the second pair of handles are to the rear of the load-bearing axis of the rear vertical supports. In this position, the second pair of handles provides a readily graspable, unobstructed and ergonomic handhold for a person to use in rising from or lowering to a seated position.

The front edge of a seat on which a user may be seated can be viewed as coincident with an imaginary vertical plane. In rising from a seated to a standing position, or in lowering from a standing position to a seated position, the person must, among other things, shift his or her center of gravity from one side of this imaginary plane to the other. When a person uses his or her hands to assist in this weight transfer, the location of the handholds relative to the person throughout the transfer affects the extent to which such handholds are of assistance. In conventional walkers, the rear vertical supports prevent the handles of the walker from crossing the imaginary vertical plane coincident with the front edge of the seat. As a result, a seated person using such a walker in rising to a standing position must grasp handles located across the plane and distant from the location of the person's center of gravity. By placing the geometric center of the second pair of handles of the walker of the present invention to the rear of the load-bearing axis of the rear vertical supports, the handles may be brought to the same side of the imaginary plane as the seated person. In so doing, the handles may be positioned close to the person's center of gravity thus affording greater leverage to be applied in rising to a standing position.

Stability is maintained during use of the second pair of handles by the load-bearing characteristics of the frame, and the rigidity of the materials used in the rear vertical supports. This stability allows the side sections of the frame to define a region in which a load is exerted at least partly outside of this region.

The second pair of handles may be affixed to and extend out from the rear vertical supports or they may be integral with the frame and part of the structure through which a pair of rigid connectors are attached to the rear vertical supports. The handles may be attached permanently to the rear vertical supports or attached to allow for subsequent adjustment and/or removal. Adjustable handles may be provided with a mechanism, such as a lock or clamp, that allows, restricts or prevents relative movement of the second pair of handles and the rear vertical supports to which they are attached. Removable handles may be subsequently re-attached or replaced with other handles of the same type or handles of a different size, shape and/or material according to the needs of the user.

Figure 4:
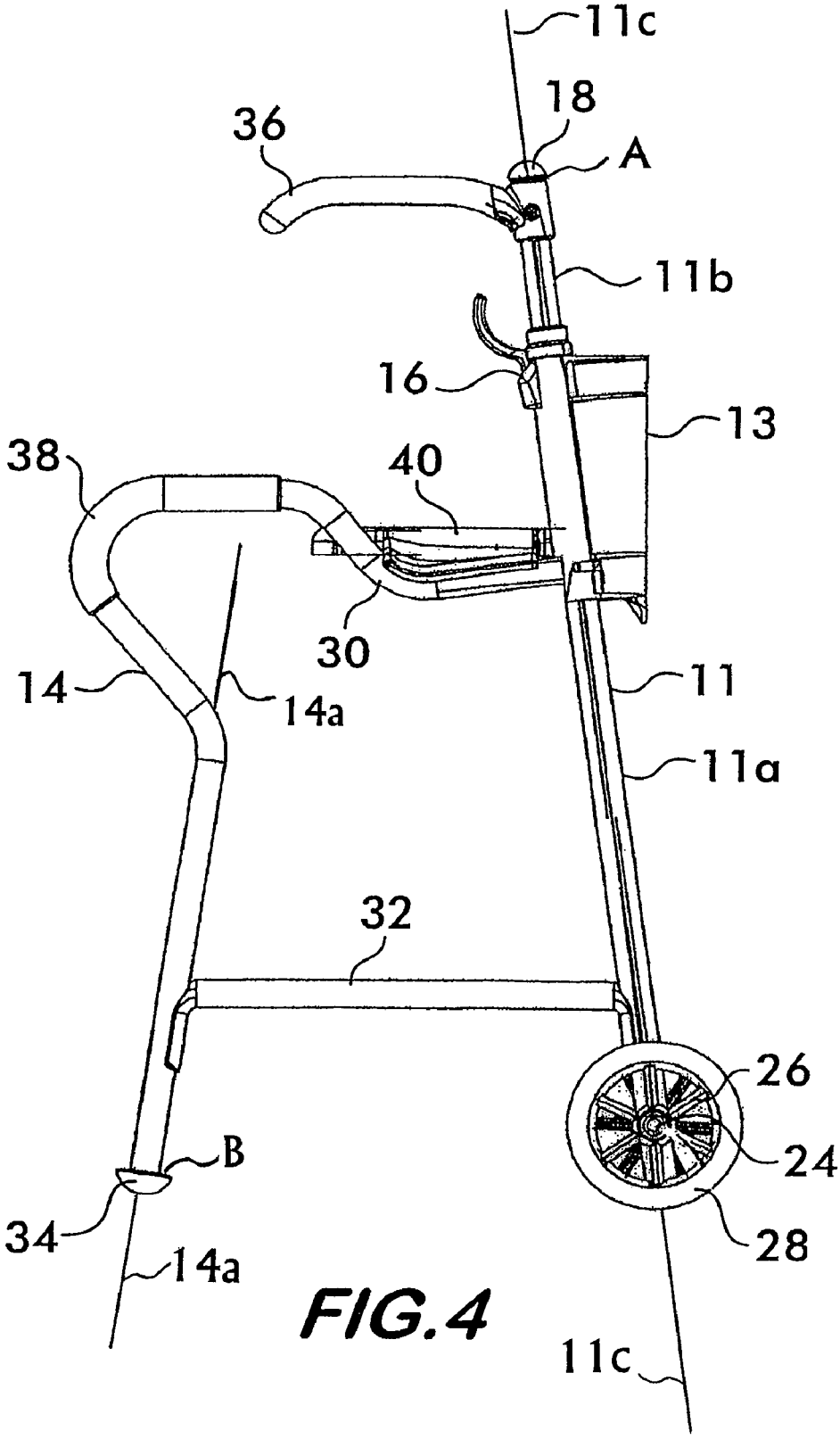
FIG. 4 is a side view of the walker as shown in FIG. 1.
Figure 5:
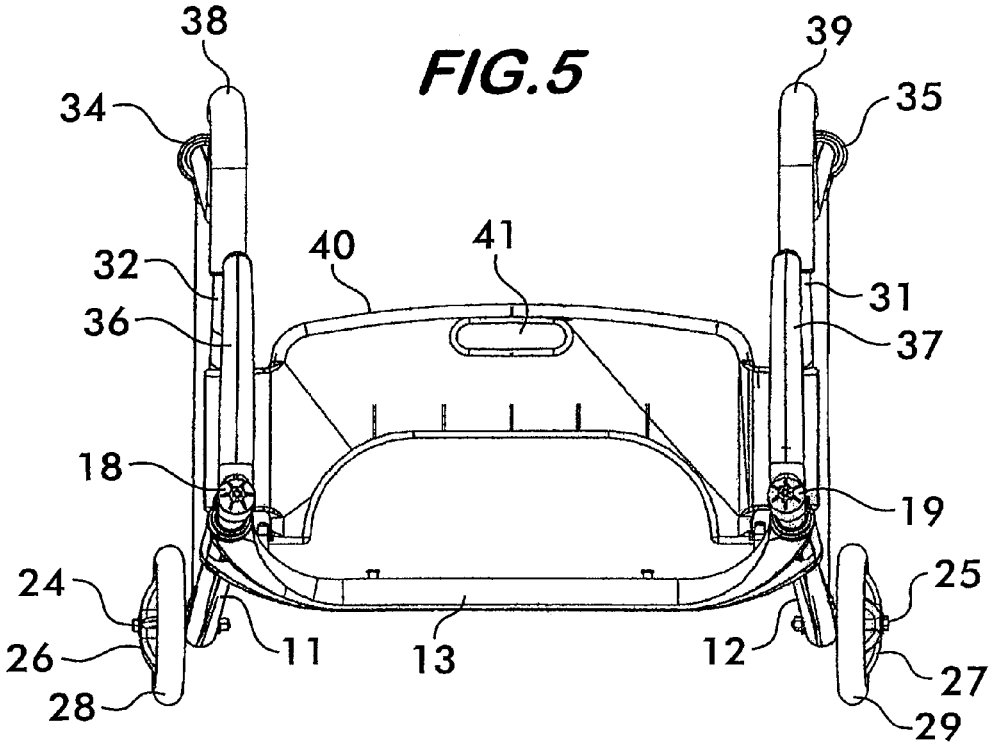
FIG. 5 is a top view of the walker as shown in FIG. 1.
Figure 6:
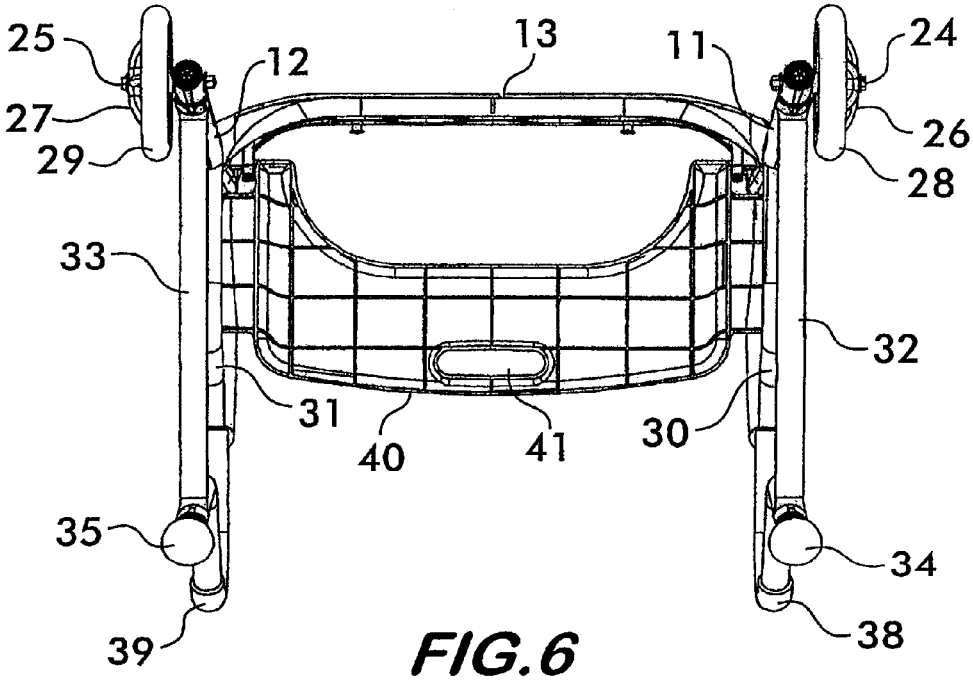
FIG. 6 is a bottom view of the walker as shown in FIG. 1.
Figure 7:
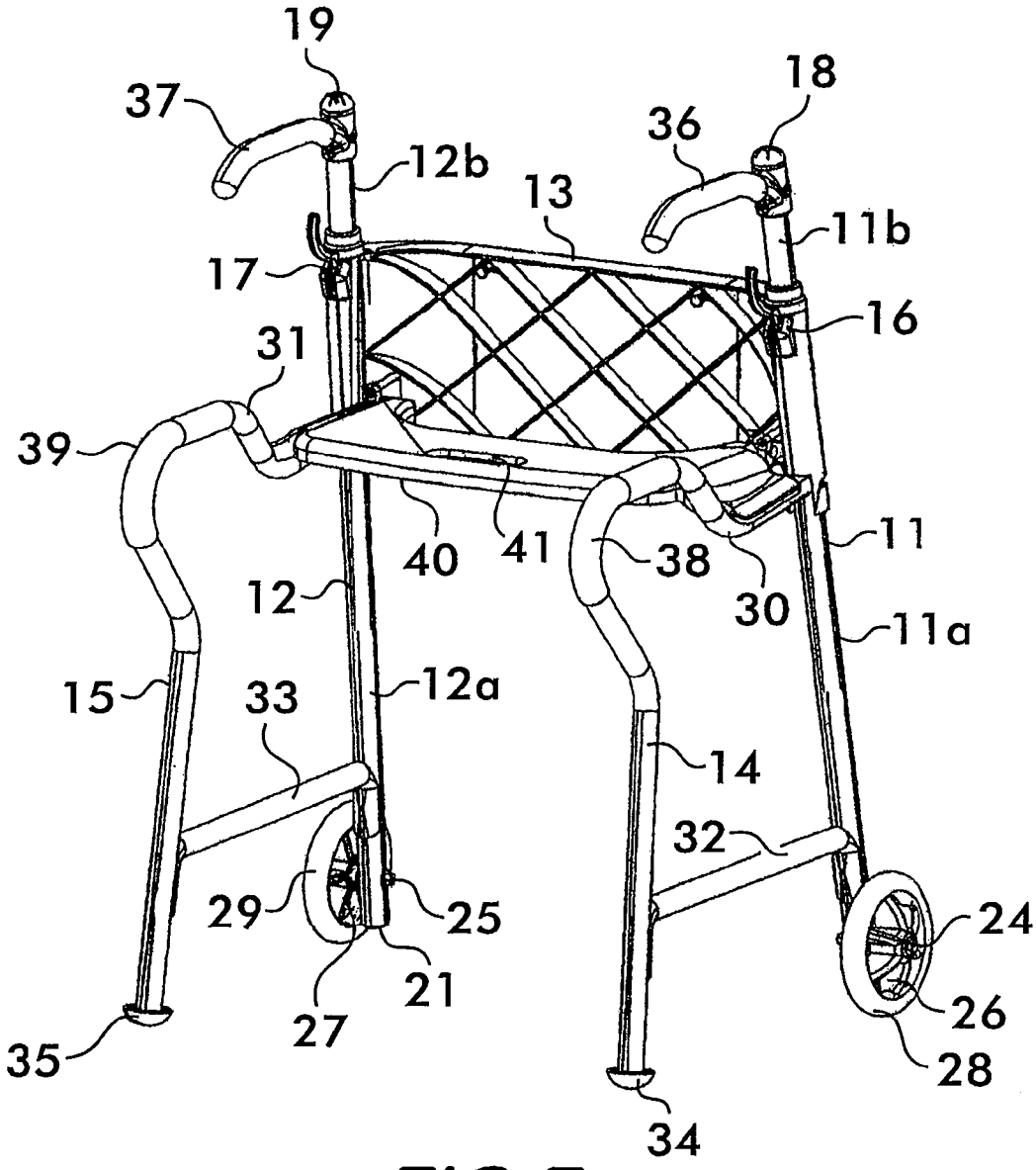
FIG. 7 is a rear perspective view of the walker as shown in FIG. 1.

An embodiment of the walker having the second pair of handles integral with the frame is shown in FIGS. 1-7. The second pair of handles 38 and 39 is spaced sufficiently from the first pair of handles 36 and 37 so as to avoid interference with use of the second pair of handles 38 and 39. The second pair of handles is located at a predetermined distance from glides 34 and 35 positioned at the bottom of rear vertical supports 14 and 15 so that the second pair of handles 38 and 39 is comfortably positioned for a seated user to grasp and use in raising himself or herself from a seated position, or in lowering himself or herself to a seated position. As shown in FIG. 4, the geometric centers of the second pair of handles 38 and 39 are positioned to the rear of the load-bearing axis of rear vertical supports 14 and 15. In this position, the handles are readily accessible to a seated person.

The walker may be further equipped with a seat that is fixedly or adjustably attached to the frame of the walker. One type of seated walker is disclosed in U.S. Pat. No. 6,371,142 to Battiston, which is incorporated herein by reference in its entirety. In one embodiment of the walker with the seat, the seat is pivotably attached at one end to the front vertical supports or the cross-piece so that the seat is movable between a generally vertical position out of the way of a person while using the walker in standing or walking, and a generally horizontal position for use as a seat. When in a lowered, generally horizontal position, the seat may be supported by braces and/or cords. In one embodiment, the rigid connectors connecting the front and rear vertical supports also serve as braces for support of the seat. FIGS. 1-7 show an embodiment of the walker having a seat 40 attached to the cross-piece 13 and supported by rigid connectors 32 and 33. The seat may be further provided with a handle for ease of movement between a generally vertical position and a generally horizontal position. FIGS. 1 and 5-7 show an embodiment of the seat 40 having a handle 41 located at the center of the back edge of the seat 40.

As shown in FIG. 4, load-bearing axis 14*a* is formed through a ground-engaging point at the lower end of rear vertical support 14. A similar load-bearing axis is formed through a ground-engaging point at the lower end of rear vertical support 15. Further, pivot axis 11*c* is positioned along front vertical support 11. FIG. 4 also shows an attachment point A for a pole or tool (not shown), and glide stem B.

Figure 8:
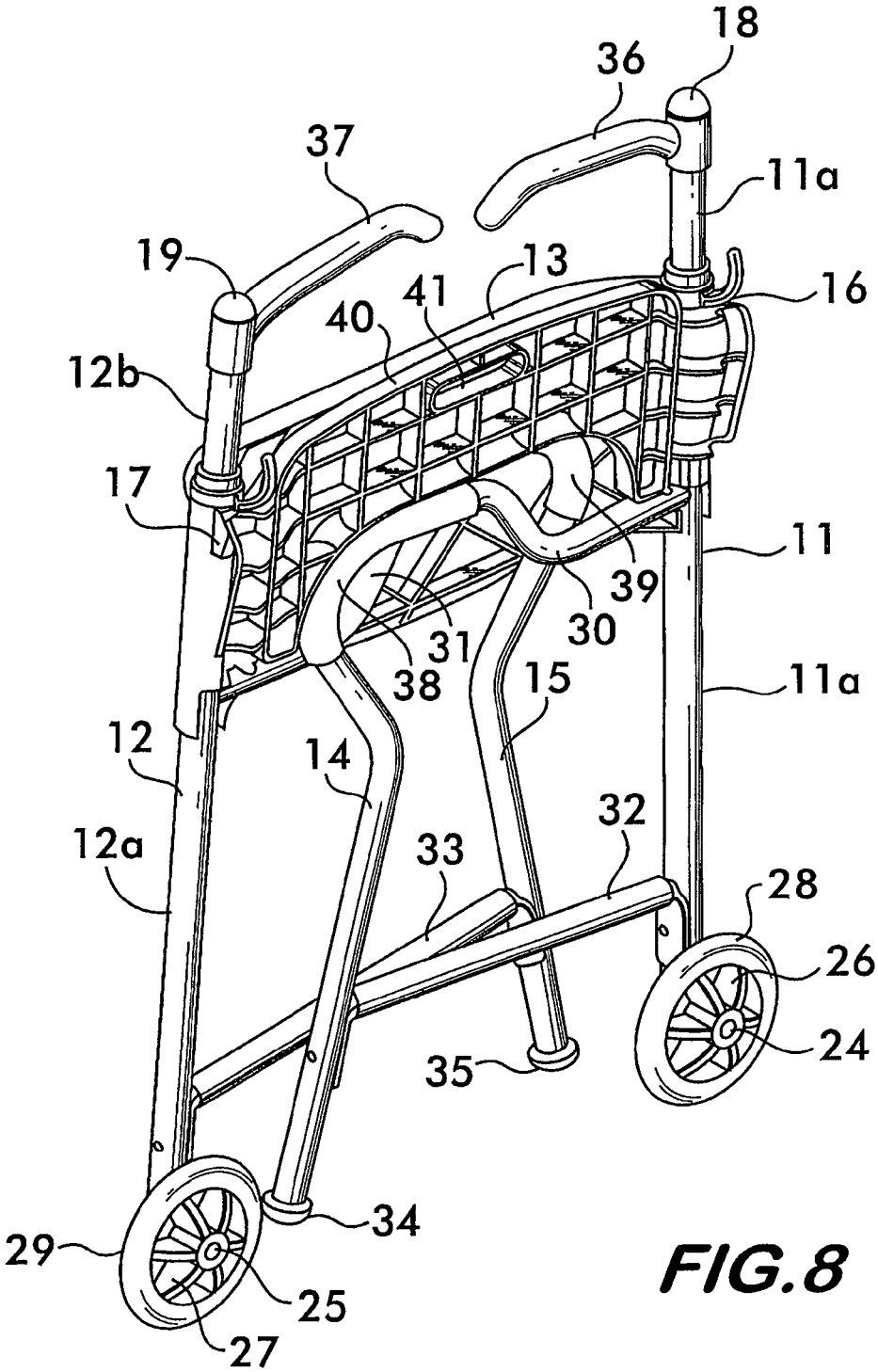
FIG. 8 is another rear perspective view of the walker as shown in FIG. 1 in which the side sections and the seat are shown in alternate positions.

As shown in FIG. 8, rear vertical supports 14 and 15 have been pivoted to a second position in which the rear vertical supports 14 and 15 are in a closed position, and seat 40 has been pivoted to a second position in which seat 40 is in a generally vertical position in order to be positioned out of the way of a person while using the walker in standing or walking.

We claim:

1. A walker, comprising:

a frame having a front section comprising a pair of front vertical supports each having an upper end and a lower end, and a rigid cross-piece having a first and a second lateral end positioned between and attached at the lateral ends to the front vertical supports, and two side sections each comprising a rear vertical support having an upper end, a lower end, and a load-bearing axis formed through a ground-engaging point at the lower end of each rear vertical support, wherein each said side section is connected to the front section by a rigid connector, and wherein the front section and the two side sections define a region of space within the walker;

a first pair of handles positioned to support a user in a standing or walking position, wherein said first pair of handles are attached to the frame at the upper end of each of the front vertical supports and extend rearward; and a second pair of handles positioned to support a user in rising from or lowering to a seated position, wherein the second pair of handles is positioned below and to the rear of the first set of handles and wherein the geometric centers of each of the second pair of handles is positioned to the rear of the load-bearing axis of each of the rear vertical supports to allow a load to be exerted at least partly outside of the region of space within the walker.

2. The walker of claim 1 further comprising a pair of pivot axes to allow pivotable movement of said side sections between a first position wherein said side sections are in an open position and a second position wherein said side sections are in a closed position.

3. The walker of claim 2 wherein the pivot axes are positioned along the front vertical supports.

4. The walker of claim 2 wherein the pivot axes are positioned at the lateral ends of the cross-piece.

5. The walker of claim 2 further comprising a pair of locking mechanisms wherein said locking mechanisms allow said side sections to be locked in either an open or closed position.

6. The walker of claim 1 wherein the frame comprises aluminum tubing.

7. The walker of claim 6 wherein said vertical supports each comprise at least two coaxial sections of tubing wherein said tubing sections allow for relative axial movement.

8. The walker of claim 7 wherein said vertical supports further comprise a locking mechanism wherein said locking mechanism restricts relative axial movement of said tubing sections.

9. The walker of claim 1 wherein said first pair of handles is adjustable relative to the upper end of said front vertical supports.

10. The walker of claim 1 wherein each of said second pair of handles is attached to the frame at the upper end of each of the rear vertical supports and extend rearward.

11. The walker of claim 10 wherein said second pair of handles is adjustable relative to said rear vertical supports.

12. The walker of claim 1 wherein each of said second pair of handles is integral with the frame.

13. The walker of claim 1 further comprising wheels attached at the lower ends of the front and/or rear vertical supports.

14. The walker of claim 13 further comprising at least one hand brake for controlling the rotational speed of the wheels.

15. The walker of claim 1 further comprising glides attached at the lower ends of the front and/or rear vertical supports.

16. The walker of claim 15 wherein said glides each comprise a stem portion for engagement with the lower end of the vertical support and a cap portion for engagement with a surface.

17. The walker of claim 1 further comprising a seat affixed to said frame, said seat being movable between a first position wherein the seat is generally positioned in a vertical position and a second position wherein the seat is generally horizontal to provide a seat for a user.

18. The walker of claim 1 further comprising at least one compartment attached to the frame for carrying personal items.

19. The walker of claim 1 wherein at least one of said front vertical supports is provided with an attachment point at the upper end of said vertical support adapted to receive a pole or tool.

20. A walker, comprising:

a frame having a front section comprising a front vertical support having an upper end and a lower end, and two side sections each comprising a rear vertical support having an upper end, a lower end, and a load-bearing axis formed through a ground-engaging point at the lower end of each rear vertical support, wherein each said side section is connected to the front section by a rigid connector, and wherein the front section and the two side sections define a region of space within the walker;

a first pair of handles positioned to support a user in a standing or walking position, wherein said first pair of handles are attached to the frame and extend rearward; and a second pair of handles positioned to support a user in rising from or lowering to a seated position, wherein the second pair of handles is positioned below and to the rear of the first set of handles and wherein the geometric centers of each of the second pair of handles is positioned to the rear of the load-bearing axis of each of the rear vertical supports to allow a load to be exerted at least partly outside of the region of space within the walker.

* * * * *